US005551938A

United States Patent [19]

Stone

[11] Patent Number: 5,551,938

[45] Date of Patent: Sep. 3, 1996

[54] RECLOSEABLE CONTAINER WITH PRESS-BONDED COLLAR

[75] Inventor: James L. Stone, Grand Rapids, Mich.

[73] Assignee: Tenneco Packaging, Evanston, Ill.

[21] Appl. No.: 257,368

[22] Filed: Jun. 9, 1994

[51] Int. Cl.[6] ..... B65D 5/54; B65D 5/56

[52] U.S. Cl. ..... 493/96; 229/225; 493/84; 493/346; 493/907; 493/930; 493/963

[58] Field of Search ..... 493/81, 84, 89, 493/96, 212, 377, 930, 963, 346, 347, 86, 87, 381, 67, 69, 74, 75, 95; 53/4–12, 133.8; 206/222, 824; 229/227, 240, 225, 161.1, 146

[56] References Cited

U.S. PATENT DOCUMENTS

| | | | |
|---|---|---|---|
| 2,502,117 | 3/1950 | Anderson | 493/96 |
| 2,836,343 | 5/1958 | Will | 229/146 |
| 3,345,918 | 10/1967 | Simeone | 493/377 |
| 3,355,995 | 12/1967 | Borkmann | 493/377 |
| 3,910,486 | 10/1975 | Stone | 229/51 R |
| 3,963,173 | 6/1976 | Stone | 229/44 CD |
| 4,141,449 | 2/1979 | Stone | 206/621 |
| 4,551,125 | 11/1985 | Pezzana | 493/346 |
| 4,732,315 | 3/1988 | Gunn | 229/125.09 |
| 4,773,542 | 9/1988 | Schillinger et al. | 206/626 |
| 4,871,345 | 10/1989 | Wosaba | 493/963 |
| 4,913,693 | 3/1990 | Ball et al. | 493/346 |
| 4,986,420 | 1/1991 | Gunn et al. | 206/607 |
| 5,129,875 | 7/1992 | Chaygneaud-Dupuy | 493/346 |
| 5,154,343 | 10/1992 | Stone | 229/225 |
| 5,161,734 | 11/1992 | Ruehl et al. | 229/227 |
| 5,236,123 | 8/1993 | Stone et al. | 229/225 |
| 5,265,799 | 11/1993 | Stone | 229/225 |
| 5,320,279 | 1/1994 | Giblin et al. | 229/225 |
| 5,328,091 | 7/1994 | Koss | 493/96 |
| 5,373,960 | 12/1994 | Gunn et al. | 220/416 |

*Primary Examiner*—Jack W. Lavinder
*Assistant Examiner*—Christopher W. Day
*Attorney, Agent, or Firm*—Arnold, White & Durkee

[57] ABSTRACT

A recloseable container comprises an outer carton and a collar disposed therein. The outer carton includes opposing top and bottom walls, opposing front and back walls, and opposing side walls. The collar is press bonded to one or more of the inner surfaces of the opposing front and back walls and the opposing side walls of the carton. The opposing side walls and the front wall of the carton include a continuous horizontal tear strip for opening up the carton from a sealed form to form a lid hingedly attached to a base section. To manufacture the recloseable container, an outer surface of a strip of collar material is press bonded to an inner surface of carton material. The attached carton material and strip of collar material are then simultaneously die-cut and scored to produce a respective carton blank and collar blank from which the recloseable container is formed.

9 Claims, 3 Drawing Sheets

RECLOSEABLE CONTAINER WITH PRESS-BONDED COLLAR

FIELD OF THE INVENTION

The present invention relates generally to paperboard or corrugated containers, cartons, and the like. More specifically, the present invention relates to a flip-top recloseable container having a press-bonded collar.

BACKGROUND OF THE INVENTION

In many consumer packaging applications, it is important to have paperboard or corrugated containers which are capable of being conveniently, yet securely, opened and reclosed repeatedly. Various approaches have been undertaken to address the repeated opening and closing/locking requirements by means of container designs using different types of interlocking flaps.

One exemplary recloseable container design, for instance, is described and illustrated in U.S. Pat. No. 5,236,123 to Stone et al., issued Aug. 17, 1993 and entitled CARTON AND LINER TEAR-TAPE ASSEMBLY. The assembly includes a carton having opposing top and bottom walls, opposing front and back walls, and opposing side walls. The liner is constructed and arranged for placement within the carton so as to provide structural support to the carton. The liner includes opposing front and back panels and opposing side panels for fitting the liner snugly inside the carton.

Moreover, the liner includes a tear-tape material on an outside surface thereof, and the carton includes a guiding cut-scored section adjacent the tear-tape material. The assembly is provided with a two-part tab which includes a first part connected to the tear-tape material and a second part connected to the cut-scored section. A user grasps the tab to remove the tear-tape material and the guiding cut-scored section, thereby opening the carton from a sealed form to form a lid hingedly attached to a base section. After lifting up the lid, the lid is reclosed by pushing the lid back down to its original position. A frictional fit between the lid and the upper portion of the liner maintains the lid in the reclosed position.

As illustrated in FIG. 2 of the foregoing U.S. patent, the liner-carton assembly is manufactured from carton and liner blanks which are separately formed. More specifically, the carton blank is formed in one die-cutting and scoring operation, and the liner blank is formed in a second die-cutting and scoring operation. At a glue station, the liner blank is positioned over and adhered to the inner surface of the carton blank. With the liner blank and carton blank attached to each other, the liner blank is folded and glued into a four-sided tubular shape to form the liner. Finally, the carton blank is appropriately folded and glued about the formed liner to form the carton.

While the above manufacturing process has an acceptable production throughput, the process is still significantly slowed by the need to separately die-cut and score the liner blank and separately form that liner blank into the liner. As stated above, the liner blank must be formed in one die-cutting and scoring operation, while the carton blank is then formed in a second die-cutting and scoring operation. Each of these die-cutting and scoring operations takes time. Furthermore, the liner blank and the carton blank must be formed into the respective liner and carton using separate folding and gluing operations. Each of these folding and gluing operations takes time.

Accordingly, a need exists for a recloseable container which overcomes the aforementioned shortcomings associated with the above type of recloseable containers.

SUMMARY OF THE INVENTION

An object of the present invention is to provide a flip-top recloseable container which is efficiently and economically manufactured at relatively high throughput rates.

Another object of the present invention is to provide a recloseable container which minimizes the use of material, thereby effecting a cost savings and minimizing the production of waste (refuse).

A further object of the present invention is to provide a flip-top recloseable container in the form of an enclosure which is easily assembled and conveniently opened and reclosed for effective dispensing of material contained therein.

In a specific embodiment of the present invention, the above and other objects are realized by providing a recloseable container including an outer carton and a collar disposed therein. The outer carton includes opposing top and bottom walls, opposing front and back walls, and opposing side walls. The collar is press bonded to one or more of the inner surfaces of the opposing front and back walls and the opposing side walls of the carton. The use of a collar, instead of a full-height liner, effects a material savings. In one preferred embodiment, the collar includes a tear-tape band on its outer surface, and the opposing side walls and the front wall of the carton include a tear strip adjacent the tear-tape band for opening up the carton from a sealed form to form a lid hingedly attached to a base section. In another preferred embodiment, the opposing side walls and the front wall of the carton include a tear strip. A reinforcing tape is attached to the inner surface of carton along the tear strip to prevent the strip from breaking apart as a result of the strip being removed from the carton during the unsealing operation.

The manufacturing method for forming the above recloseable container first comprises the steps of providing a sheet or roll of carton material and providing a strip of collar material. Next, a portion of the outer surface of the strip of collar material is press bonded to an inner surface of the carton material. With the strip of collar material press bonded thereto, the carton material is die-cut and scored to produce a carton blank for constructing carton. While die-cutting and scoring the carton material, the strip of collar material is simultaneous cut and scored to produce a collar blank. Finally, the carton blank, with the collar blank attached thereto, is folded and glued to form the carton with the collar disposed therein.

Using the foregoing manufacturing method, one die-cutting and scoring operation is employed to produce both the carton and collar blanks. Similarly, one folding and gluing operation is used to form the carton with the collar disposed therein. Thus, the recloseable container is manufactured at high throughput rates with a minimal amount of material waste.

BRIEF DESCRIPTION OF THE DRAWINGS

Other objects and advantages of the invention will become apparent upon reading the following detailed description and upon reference to the drawings in which.

Figure 1:
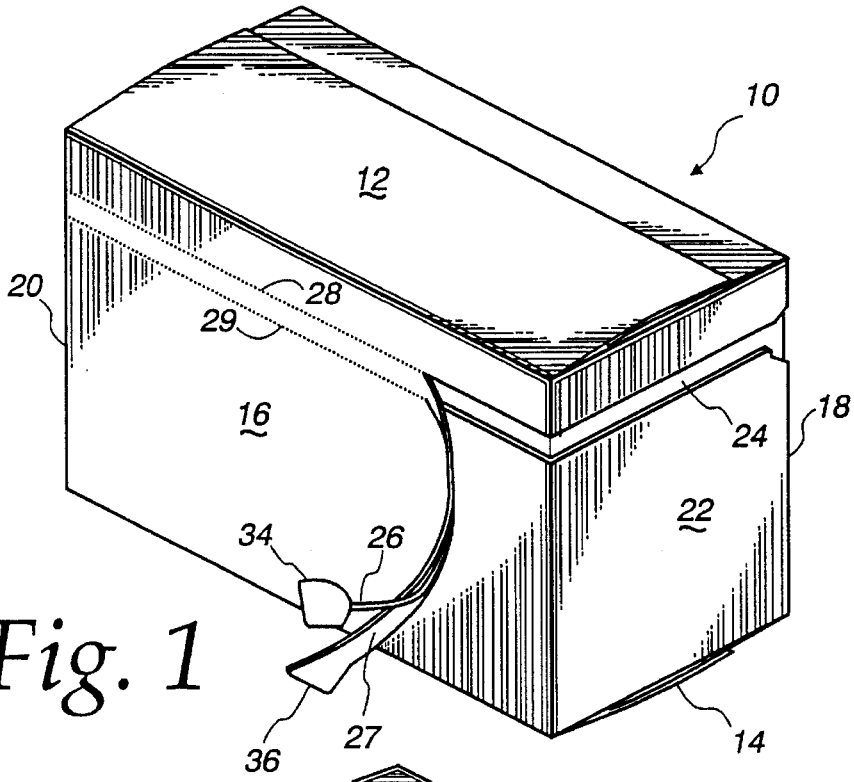
FIG. 1 is a perspective view of a recloseable container embodying the present invention, showing the container in its closed form with the tear strip partially pulled open.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Referring now to the drawings and in particular to FIG. 1, there is shown a perspective view of an exemplary flip-top, recloseable container having an outer carton 10 which is a six-sided parallelopiped enclosure formed of three pairs of opposing, generally rectangular walls or panels. More specifically, the carton 10 includes opposing top and bottom walls 12 and 14, opposing front and back walls 16 and 18, and opposing side walls 20 and 22.

A collar 24 is press bonded to one or more of the inner surfaces of the opposing front and back walls 16, 18 and the opposing side walls 20, 22 of the carton 10. The collar 24 preferably extends from an upper edge of the top wall 12 of the carton 10 to a location spaced a substantial distance from the bottom wall 14 of the carton 10. For example, if the distance between the top and bottom walls 12, 14 of the carton 10 is approximately six inches, the collar is preferably less than two inches wide. Thus, the collar 24 effects a substantial material savings relative to a full-height liner extending from the top wall 12 to the bottom wall 14, thereby minimizing the cost associated with materials used for manufacturing the recloseable container.

Figure 4:
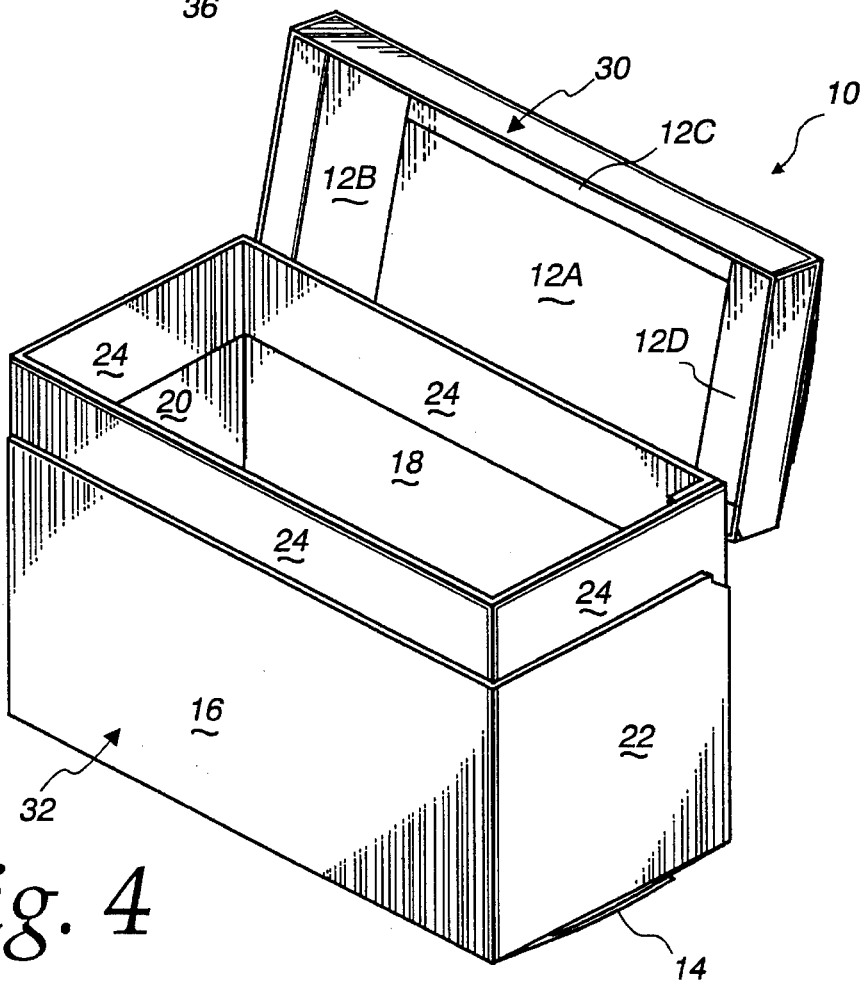
FIG. 4 is a perspective view of the recloseable container in FIG. 1, showing the container in its open form with the lid raised upwardly to open the container.

In one preferred embodiment, to permit a user to initially open the carton 10 from a sealed form, the collar 24 preferably includes a tear-tape band 26 on its outer surface, and the opposing side walls 20, 22 and the front wall 16 of the carton 10 include a tear strip 27. The tear strip 27 is formed by a pair of guiding perforation-like (e.g., zipper perforation) or cut-scored parallel lines 28, 29, and the tear strip 27 is located adjacent the tear-tape band 26 for opening up the carton 10 from a sealed form to form a lid 30 hingedly attached to a base section 32 (FIG. 4). If, for example, the carton 10 is approximately six inches in height and the collar 24 is approximately two inches wide, the tear-tape band 26 is located about an inch below the top edge of the collar 24. The recloseable lid 30 is formed once the tearing of the tear strip 27 around the opposing side walls and front wall has been completed.

To permit the lid 30 to be raised upwardly from the base section 32 while the collar 24 is retained on the base section 32 (FIG. 4), the collar 24 is adhered to the carton 10 only at locations below the tear strip 27.

To enable a user to simultaneously hand-grasp the tear-tape band 26 and the tear strip 27, the recloseable container is provided with a two-part tab. The two-part tab includes a tear-tab 34 integrally formed with the tear-tape band 26 and a pull-tab 36 integrally formed with the tear strip 27. The tear-tab 34 of the collar 24 and the pull-tab 36 of the carton 10 may be adhered together or may be left detached. By simultaneously grasping and pulling the tear-tab 34 and the pull-tab 36, the tear-tape band 26 breaks through the carton 10 along the tear strip 27 so as to tear the parallel lines 28, 29 and divide the carton 10 into the lid 30 and the base section 32.

FIGS. 1 and 4 illustrate the recloseable container "before" and "after" the tear-tab 34 and the pull-tab 36 have been pulled together along the tear strip 27 around the opposing side walls 20, 22 and the front wall 16 of the carton 10. As depicted in FIG. 1, pulling the tear-tab 34 and the pull-tab 36 along the tear strip 27 only causes the tear-tape band 26 (and possibly a thin outside layer of the collar 24) to tear away from the collar 24. The remainder of the collar 24 remains structurally intact for supporting the contents of the carton all the way to the top of the collar 24. As illustrated in FIG. 1, the collar 24 within the outer carton 10 is exposed where the carton 10 has been torn away. Therefore, the collar 24 prevents spillage of the carton contents through the torn-away region between the parallel lines 28, 29.

The end result, as shown in FIG. 4, is a container having the recloseable flip-top lid 30 and the base section 32 with the collar 24 extending upwardly from the base section 32. The hinged lid 30 recloses onto the base section 32 by virtue of frictional engagement between the inner surface of the lid 30 and the outer surface of the collar 24. With the lid 30 raised upwardly relative to the base section 32, the collar 24 serves to maintain the full height of the recloseable container and prevent spillage of the carton contents at locations above the base section 32. Further information regarding a tear-tape band and tear strip of the type described above may be obtained by reference to U.S. Pat. No. 5,236,123 to Stone et al., issued Aug. 17, 1993, entitled CARTON AND LINER TEAR-TAPE ASSEMBLY, and incorporated herein by reference.

Figure 2:
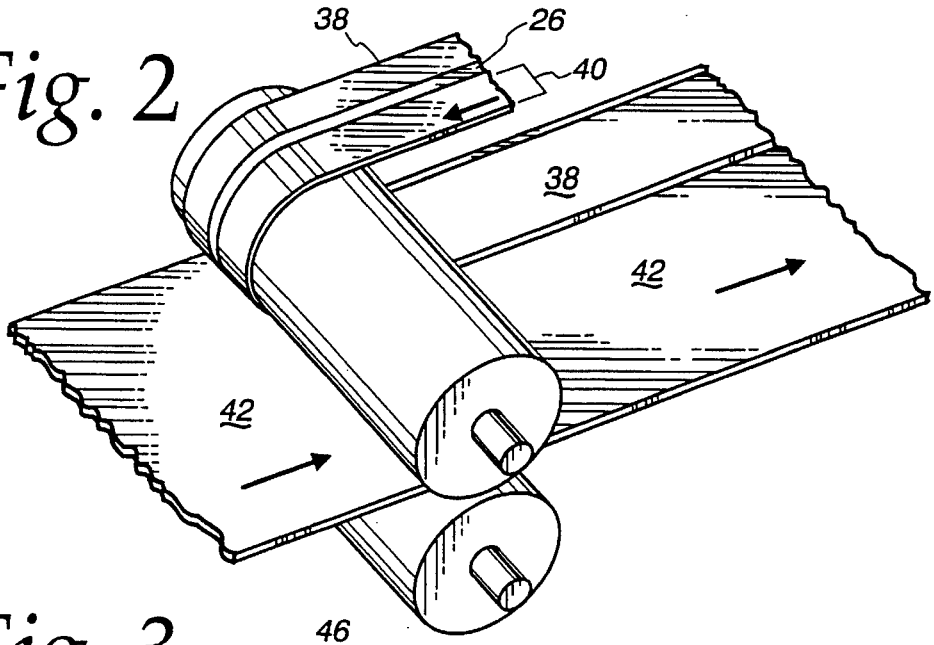
FIG. 2 is a perspective view of a process for press bonding collar material to carton material, in accordance with one embodiment of the present invention.

Referring now to FIG. 2, to manufacture the recloseable container illustrated in FIGS. 1 and 4, tear-tape material for forming the tear-tape band 26 is preapplied to an outer surface of a strip 38 of collar material. The collar material is preferably either paperboard, thick paper (e.g., 60 pound paper), or flexible plastic. The tear-tape material is implemented using a conventional open-assist tape-type material, for example, a hot-melt filament type tape, which is available from HB Fuller Co. or other types such as non-reinforced plastic film pressure sensitive tape. Application of this tape to the collar strip 38 is accomplished using conventional heating means or conventional application systems well known to those practiced in the art.

Figure 3:
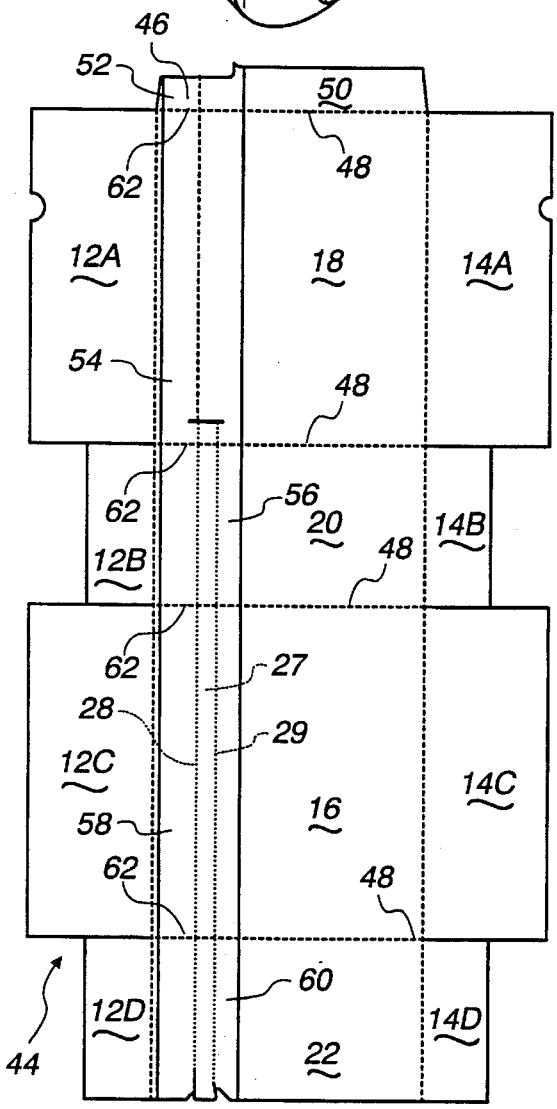
FIG. 3 is a plan view of the inside surface of a die-cut carton blank used to form the outer carton of the recloseable container in FIG. 1, showing the carton blank with the collar bonded thereto.

After pre-applying the tear-tape material to the strip 38 of collar material, the portion 40 of the strip 38 below the tear-tape material (as viewed in FIG. 2) is press bonded to carton material 42 using an adhesive such as glue. The bond created between the collar strip 38 and the carton material 42 may be either continuous or intermittent. The carton material is supplied in the form of sheets of corrugated board or rolls of paperboard. Next, with the strip 38 of collar material press bonded thereto, the carton material 42 is die-cut and scored to produce a carton blank 44 illustrated in FIG. 3. While die-cutting and scoring the carton material 42, the strip 38 of collar material is simultaneous cut and scored to produce a collar blank 46 which is also illustrated in FIG. 3. The collar blank 46 is fixedly adhered to the carton blank 44 at locations to the right of the tear-tape band 26 and the tear strip 27 (as viewed in FIG. 3).

The carton blank 44 in FIG. 3 is in the form of a single, planar, unitary section of paperboard or corrugated board which includes four vertically aligned, substantially rectangular panels 16, 18, 20, and 22 linked to each other by horizontal score lines 48 which facilitate folding of the carton panels relative to each other. With respect to the closed carton in FIG. 1, corresponding parts are indicated by the same reference numerals.

Each of the four main panels comprising the carton blank 44 is provided with a pair of flaps connected along opposing vertical edges by corresponding score lines. More specifically, the back wall panel 18 includes a left end closure flap 12A and a right end closure flap 14A. Similarly, left end and right end dust flaps 12B, 14B are associated with the side wall panel 20, left and right end closure flaps 12C, 14C are associated with the front wall panel 16, and left and right end dust flaps 12D, 14D are associated with the other side wall panel 22. In the illustrative embodiment of FIG. 3, the end closure flaps 12A, 14A, 12C, and 14C have substantially the same vertical and horizontal dimensions (as viewed in FIG. 3), and the end dust flaps 12B, 14B, 12D, and 14D have substantially the same vertical and horizontal dimensions.

The flaps associated with the four main panels interact in a conventional manner to form the top wall 12 and the bottom wall 14 of the carton 10. With respect to the manner in which these flaps interact to form the closed carton shown in FIG. 1, the left end flaps 12A, 12B, 12C, and 12D form the top wall 12, and the right end flaps 14A, 14B, 14C, and 14D form the bottom wall 14.

The collar blank 46 is adhered to the carton blank 44 along left portions (as viewed in FIG. 3) of one or more of the opposing front and back wall panels 16, 18 and the opposing side wall panels 20, 22, but to the right of the tear strip 27 (as viewed in FIG. 3). The left edge of the collar blank 46 substantially coincides with the left edges of the foregoing carton panels so that in the closed carton 10 in FIG. 1, the collar 24 extends upwardly in close proximity to the top wall 12. While forming the collar blank 46 during the die-cutting and scoring operation described above, the collar blank 46 is partitioned into five vertically aligned, substantially rectangular panels 52, 54, 56, 58, and 60 linked to each other by horizontal score lines 62 which facilitate folding of the collar panels relative to each other. Since the collar score lines 62 are simultaneously formed with the carton score lines 48, the collar score lines 62 are substantially aligned with the carton score lines 48. Furthermore, the vertical dimensions (as viewed in FIG. 3) of the collar panels 52, 54, 56, 58, and 60 are substantially similar to the vertical dimensions of the respective carton panels 50, 18, 20, 16, and 22.

In the carton blank 44 illustrated in FIG. 3, the side wall panels 20, 22 and the front wall panel 16 have the tear strip 27 extending integrally across the panels. The tear-tape band 26 on the collar blank 46 abuts against the tear strip 27 between the parallel score lines 28, 29.

It should be noted that the manner in which the container in FIG. 1 is assembled from the carton blank 44 and the collar blank 46 in FIG. 3 is fairly conventional and is, accordingly, not described in detail herein. It suffices to state herein that the carton blank 44, with the collar blank 46 attached thereto, is initially folded about the horizontal score lines 48 to form an open-ended generally rectangular, four-sided tubular body. To maintain the carton blank 44 in this tubular shape, inner surfaces of the side wall panel 22 and the collar panel 60 are adhered to the outer surface of the glue flap 50 by an adhesive such as glue. As illustrated in FIG. 3, the glue flap 50 is hingedly connected to the back wall panel 18 by means of the horizontal score line 48. Since the collar panel 60 is disposed between the carton glue flap 60 and the carton side wall panel 22, the tear-tab 34 and the pull-tab 36 are positioned immediately adjacent each other without any intervening panels.

Closing the open-ended tubular body to form the closed container in FIG. 1 is preferably performed in two stages: first, closing and sealing one end (top wall or bottom wall) of the carton 10, and next filling the container with the requisite contents prior to closing the remaining end of the carton 10 to yield a closed and entirely sealed container.

Figure 5:
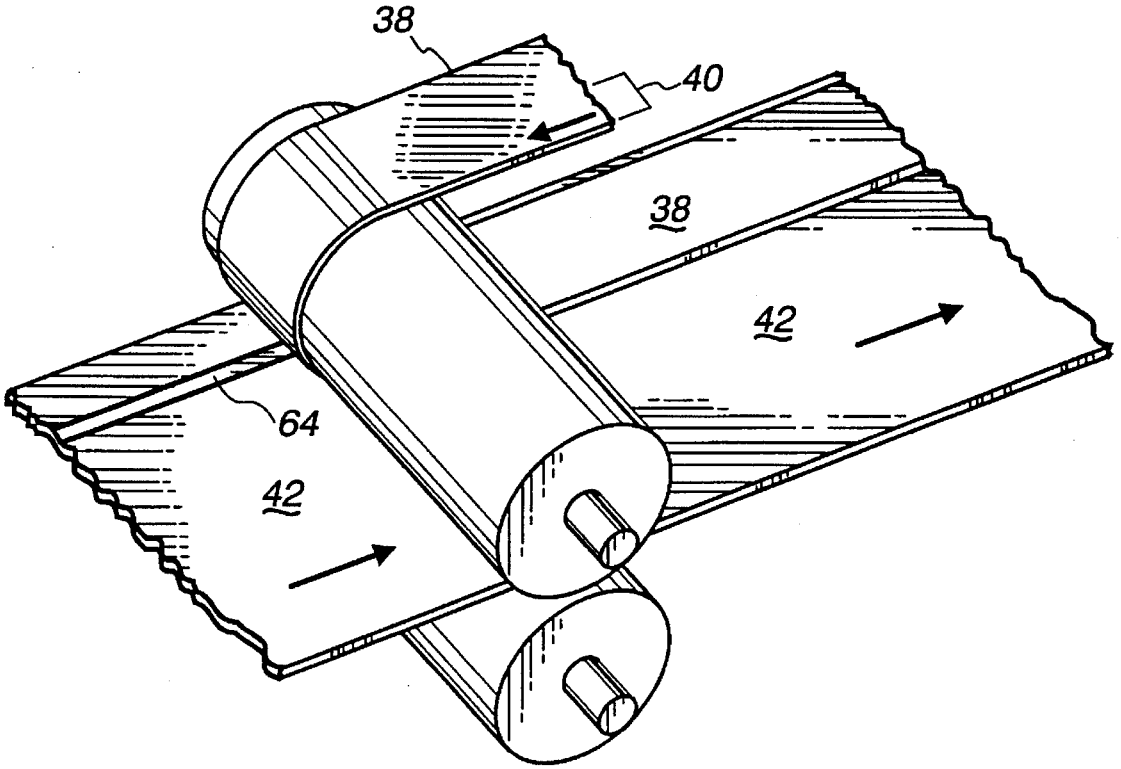
FIG. 5 is a perspective view of a process for press bonding collar material to carton material, in accordance with another embodiment of the present invention.

In another preferred embodiment, the recloseable container is provided with a tear strip, such as the tear strip 27, on the carton 10 without employing the tear-tape band 26 on the collar 24. Instead of employing the tear-tape band 26 on the collar 24, a continuous reinforcing tape is preferably attached to the inner surface of the carton 10 along the tear strip 27 to prevent the strip 27 from breaking apart as a result of the strip 27 being removed from the carton 10 during the unsealing operation. As illustrated in FIG. 5, during the manufacture of the container, the reinforcing tape 64 is pre-applied to the inner surface of carton material 42. Application of the reinforcing tape 64 to the carton material 42 is accomplished using conventional heating means or conventional application systems well known to those practiced in the art. In the assembled form of the container, the reinforcing tape 64 is aligned with the tear strip 27 of the carton 10. The foregoing type of tear strip with reinforcing tape is described in U.S. Pat. Nos. 5,154,343, 5,265,799, and 5,314,114 to Stone, which are incorporated herein by reference.

While the present invention has been described with reference to one or more particular embodiments, those skilled in the art will recognize that many changes may be made thereto without departing from the spirit and scope of the present invention.

For example, the width of the collar 24 may be modified so that the collar is relatively narrow compared to the illustrated collar 24 or is relatively wide compared to the illustrated collar 24. Furthermore, it is not necessary for the collar 24 to have four full sides. Instead, the collar may be provided with a front side and a pair of opposing sides. To manufacture such a three-sided collar, the collar panels 52, 54 of the collar blank 46 are severed and removed from the collar blank 46 during the die-cutting and scoring step of the production process. In order that these severed panels may be removed from the carton blank 44 to which the collar blank 46 is press bonded, only one or more of the panels 56, 58, and 60 are bonded to the carton blank 44.

Each of these embodiments and obvious variations thereof is contemplated as falling within the spirit and scope of the claimed invention, which is set forth in the following claims.

What is claimed is:

1. A method of manufacturing a recloseable container, comprising the steps of:

supplying a sheet of carton material and a strip of collar material separate from the sheet of carton material;

adhesively press bonding an outer surface of the strip of collar material to an inner surface of the sheet of carton material; and after adhesively press bonding the strip of collar material to the sheet of carton material, simultaneously die-cutting and scoring the sheet of carton material and the strip of collar material into a respective carton blank and collar blank; and folding the respective blanks to produce a carton having opposing top and bottom walls, opposing front and back walls, and opposing side walls and a collar disposed within the carton and extending substantially from the top wall to a location spaced away from the bottom wall.

2. The method of claim 1, further including the step of forming the carton blank into the carton with the collar disposed therein, the collar being formed from the collar blank while the carton is formed from the carton blank.

3. The method of claim 1, wherein said step of simultaneously die-cutting and scoring the sheet of carton material and the strip of collar material into a respective carton blank and collar blank includes forming a continuous tear strip across the carton blank, the tear strip constructed and arranged to open up the carton from a sealed form to form a lid hingedly attached to a base section.

4. The method of claim 1, wherein the collar blank is constructed and arranged relative to the carton blank such that the collar is attached to one or more of the inner surfaces of the front wall and the opposing side walls of the carton.

5. The method of claim 4, wherein the collar blank is constructed and arranged relative to the carton blank such that the collar is attached to one or more of the inner surfaces of the opposing front and back walls and the opposing side walls of the carton.

6. The method of claim 1, further including the step of pre-applying tear-tape material to an outer surface of the strip of collar material such that the formed collar blank includes a tear-tape band, and wherein said step of simultaneously die-cutting and scoring the sheet of carton material and the strip of collar material into a respective carton blank and collar blank includes forming a tear strip on the carton blank adjacent the tear-tape band of the collar blank.

7. The method of claim 6, wherein said step of simultaneously die-cutting and scoring the sheet of carton material and the strip of collar material into a respective carton blank and collar blank includes forming a tab having a first portion connected to the tear-tape band of the collar blank and a second portion connected to the tear strip of the carton blank.

8. The method of claim 7, further including the step of connecting the first and second portions of the tab to each other.

9. The method of claim 2, further including the step of pre-applying reinforcing tape to an inner surface of the sheet of carton material, and wherein said step of simultaneously die-cutting and scoring the sheet of carton material and the strip of collar material into a respective carton blank and collar blank includes forming a tear strip on the carton blank along the reinforcing tape of the carton blank.

* * * * *